United States Patent [19]

Miller

[11] Patent Number: 4,571,981

[45] Date of Patent: Feb. 25, 1986

[54] SPIKE STRAIGHTENING APPARATUS

[75] Inventor: John R. Miller, Charlotte, N.C.

[73] Assignee: Southern Railway Company, Washington, D.C.

[21] Appl. No.: 590,006

[22] Filed: Mar. 15, 1984

[51] Int. Cl.[4] ..... B21D 3/16; B21J 7/18

[52] U.S. Cl. ..... 72/400; 72/304; 72/385; 72/424; 72/427; 72/451

[58] Field of Search ..... 72/316, 315, 304, 322, 72/323, 385, 400, 399, 409, 407, 450, 451, 427, 424

[56] References Cited

U.S. PATENT DOCUMENTS

| | | | |
|---|---|---|---|
| 226,901 | 4/1880 | Carter | 72/450 |
| 355,304 | 1/1887 | Dow . | |
| 1,298,806 | 4/1919 | Skrzynecki | 83/552 |
| 1,418,026 | 5/1922 | Schmidt et al. . | |
| 1,464,755 | 8/1923 | Ditson et al. | 72/316 |
| 1,620,260 | 3/1927 | Kellogg . | |
| 1,923,272 | 8/1933 | Maroto . | |
| 2,541,544 | 2/1951 | Rahaim | 72/399 |
| 2,756,428 | 7/1956 | Kellersman | 72/451 |
| 2,829,547 | 4/1958 | Barnes | 72/409 |
| 2,832,244 | 4/1958 | Olson | 72/409 |
| 3,051,216 | 8/1962 | Tomka et al. . | |
| 3,166,960 | 1/1965 | Roessler . | |
| 3,451,250 | 6/1969 | Rolf et al. | 72/451 |
| 3,908,434 | 9/1975 | Ribback . | |
| 4,091,652 | 5/1978 | Wilcox | 72/400 |

FOREIGN PATENT DOCUMENTS

| | | | |
|---|---|---|---|
| 1010138 | 6/1952 | France | 72/385 |

*Primary Examiner*—Daniel C. Crane

*Attorney, Agent, or Firm*—Watson, Cole, Grindle & Watson

[57] ABSTRACT

An apparatus for straightening a rail spike or the like includes a pair of said facing support arms mounted for pivotal movement about spaced axes on a frame, male die blocks mounted on the arms for movement therewith toward confronting angularly related surfaces of a female die member. A plurality of such female die members may be mounted on a rotatable support table such that the support surfaces of the female dies define radially extending angular grooves. The support table may be incrementally rotated for sequentially effecting a spike straightening operation, the table being locked at the spike straightening station and thereafter automatically ejected.

10 Claims, 7 Drawing Figures

SPIKE STRAIGHTENING APPARATUS

BACKGROUND OF THE INVENTION

This invention relates generally to an apparatus for straightening an elongated article, such as a rail spike, and more particularly to such an apparatus in which a pair of male die blocks attached to side facing pivot arms are simultaneously swung toward a female die member for pressing against the spike shank supported on surfaces of the female die member defining an angular groove.

Bolt or rod straightening devices are known in which male die blocks or hammers slide along guideways for impacting against support surfaces of a female die or the like defining an angular groove. Otherwise, a pair of dies having angular grooves, between which the object to be straightened is pressed, are relatively moved together and have spaced recesses defining fingers permitting interdigitation of the dies when closed together.

These straightening devices are, however, generally unreliable and not wholly effective in accurately straightening a bent rod or rail spike. Besides, the movement of male die parts along guideways induces drag and snags which have a tendency to cause premature wear of the parts requiring frequent replacement of the guideways and/or the male die members. Moreover, the known straightening devices are generally unsuitable for automated large-scale straightening operations carried out sequentially for a plurality of elongated articles.

SUMMARY OF THE INVENTION

It is therefore an object of the present invention to provide an apparatus for straightening an elongated article, such as a rail spike, which is easy to assemble and operate, highly efficient, economical to manufacture, and having improved reliability.

Another object of this invention is to provide such an apparatus wherein a pair of side facing pivot arms support male die blocks for pressing against a bent elongated article supported on angularly related surfaces of a female die member, the pivot arms being connected to a hydraulic ram or the like for simultaneously pivoting the arms toward the female die for straightening the article.

A further object of the present invention is to provide such an apparatus wherein the male die blocks are moved along the surfaces of the female die member closely adjacent thereto, the female die surfaces respectively confronting and lying opposed to the ends of the male die blocks.

A still further object of the present invention is to provide such an apparatus wherein portions of the male die block ends have spaced grooves of equal width and parallel sides alternating between the blocks so that, upon movement thereof, portions of one of the blocks will be received within the grooves of the other.

A still further object of this invention is to provide such an apparatus wherein a plurality of female die members having angularly related support surfaces are mounted on a table surface rotatable about a central axis, the table being rotated incrementally for sequentially disposing the female die members beneath the male die blocks at a straightening station, and being locked in place during the straightening operation.

A still further object is to provide a pressurized article reforming assembly for applying pressure against one end of the female die member in a directon along its annular groove defined by its angularly related surfaces, so that the head of a headed elongated article, such as a rail spike, can be reformed relative to its shank by pressing the head against the one end of the female die member.

A still further object is to provide an ejector spaced from the straightening station and spaced outwardly of one end of the female die member thereat along its annular groove for ejecting the straightened article from the female die member.

Other objects, advantages and novel features of the invention will become more apparent from the following detailed description of the invention when taken in conjunction with the accompanying drawings.

DETAILED DESCRIPTION OF THE INVENTION

Figure 1:
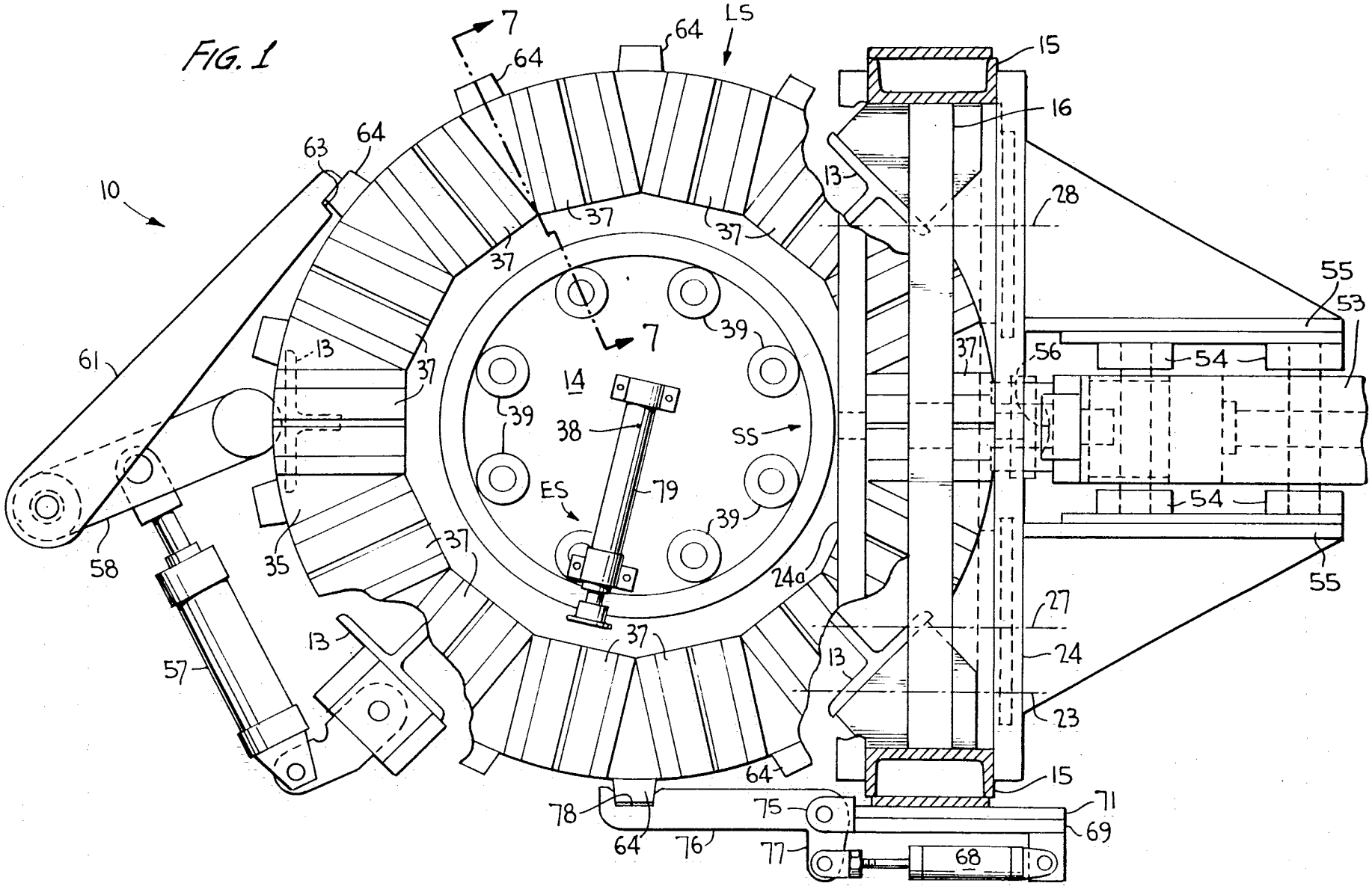
FIG. 1 is a top plan view of the article straightening apparatus according to the invention.
Figure 2:
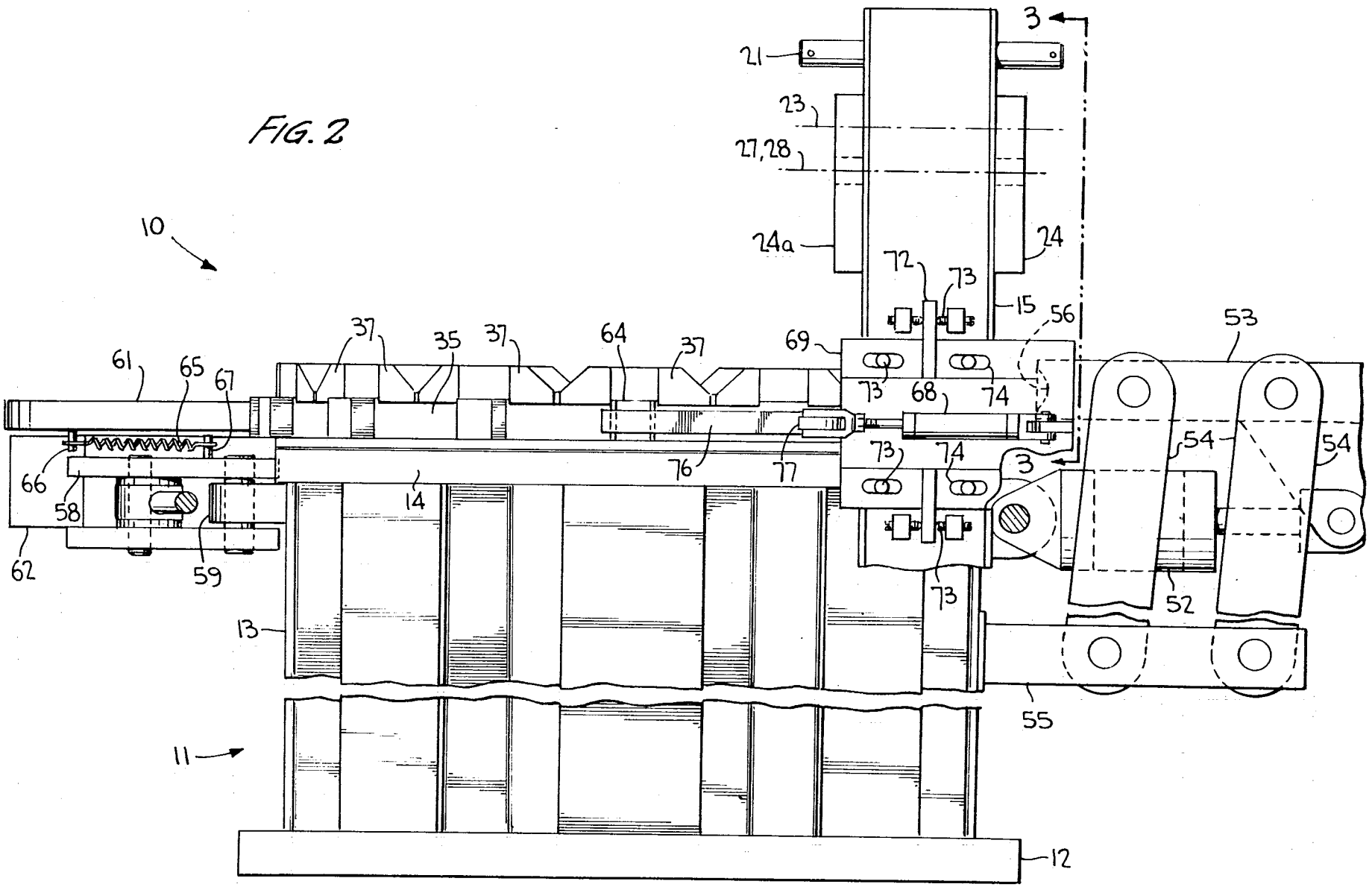
FIG. 2 is an elevational view of the FIG. 1 apparatus taken substantially along the line 2—2 thereof.
Figure 3:
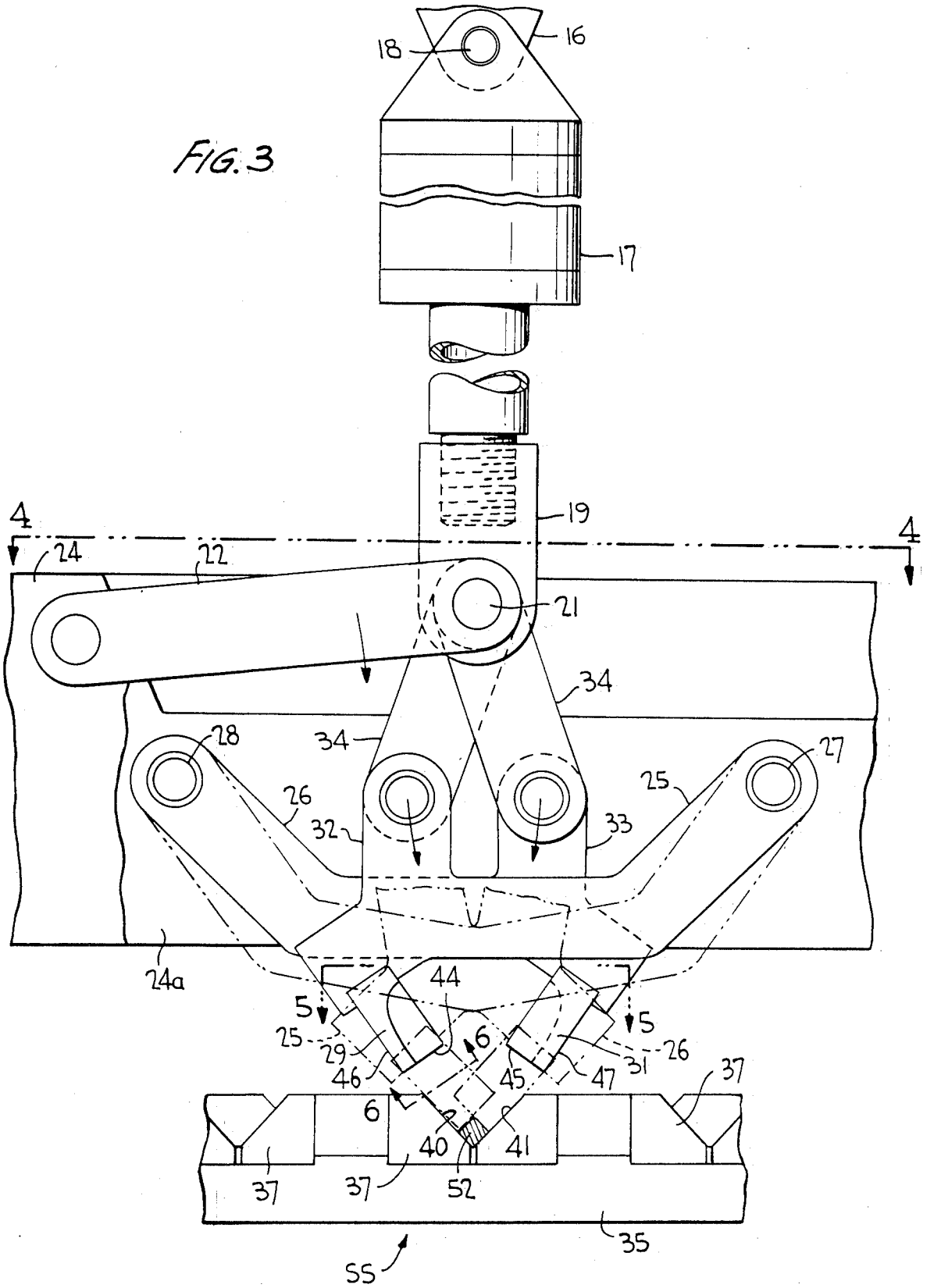
FIG. 3 is a view taken substantially along the line 3—3 of FIG. 2 of the male and female die assembly provided for effecting article straightening.

Turning now to the drawings wherein like reference characters refer to like and corresponding parts throughout the several views, the overall spike straightening apparatus is generally designated 10 in FIGS. 1 and 2, and the spike straightening assembly thereof is shown in detail in FIG. 3. The overall apparatus has a frame 11 which includes a base plate 12 (FIG. 2) on which a plurality of support I-beams 13 are mounted. A support plate 14 is mounted on the upper ends of these beams, and a pair of spaced, upright channel beams 15 are supported on plate 14. A crossbar 16 extends between beams 15, and a main hydraulic piston and cylinder unit 17 is suspended thereon via a pivot pin 18. A clevis 19 is threadedly secured to the piston end, and a clevis pin 21 extends transversely through a suitable opening in the clevis.

Figure 4:
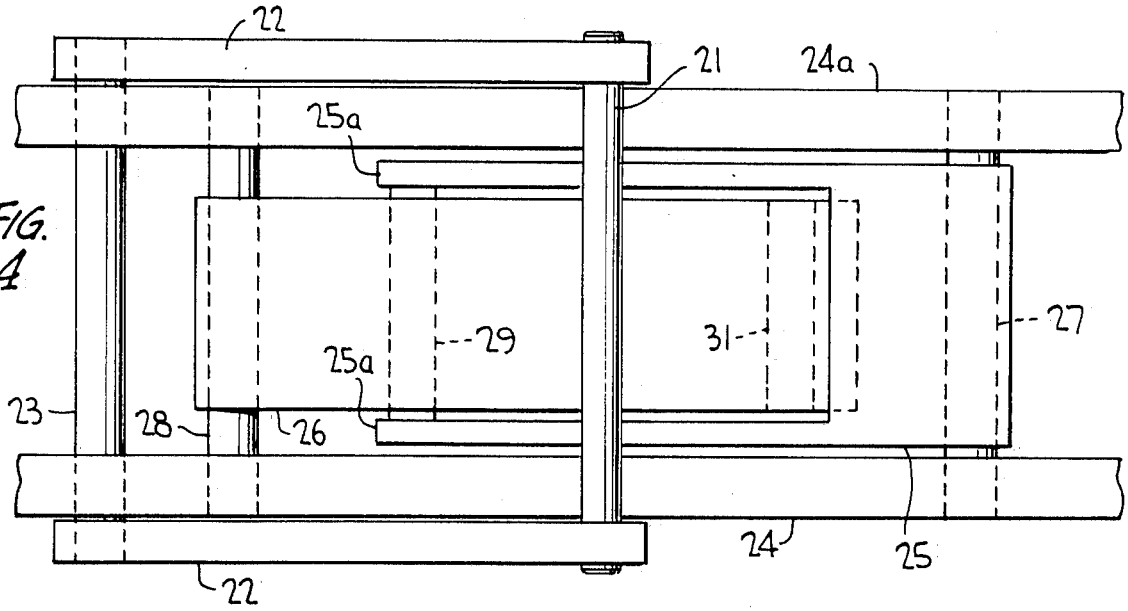
FIG. 4 is a view taken substantially along the line 3—3 of FIG. 3.

Guide arms 22 are pivotally connected at one end to the clevis pin at opposite sides of the clevis, and are pivotally connected as at 23 to the outer sides of portions 24, **24*a* (FIG. 4) of the frame. Male die pivot arms 25 and 26 are disposed between portions 24, 24*a* of the frame and are mounted thereon of pivot pins 27 and 28 extending between these frame portions (FIG. 4) and lying in the same horizontal plane. Pivot arm 25 has a pair of spaced yoke legs 25*a* interconnected at the free ends thereof by a transversely extending, rigidly connected male die block 29. Pivot arm 26 extends between legs 25*a* of pivot arm 25. Another male die block 31 is mounted on pivot arm 26 adjacent its free end. Connecting ears 32 (FIG. 3) extend upwardly from legs 25*a* of pivot arm 25, and connecting ears 33 extend upwardly from pivot arm 26. Connecting links 34 are pivotally connected at opposite ends to the connecting ears and to clevis pin 21**.

Thus, upon actuation of main cylinder 17, its piston rods extends downwardly causing guide rods 22 to pivot in the direction of the arrow of FIG. 3. These rods 22 function to stabilize the clevis and prevent it from undue shifting movement along pin 21. As the clevis is lowered, links 34 effect pivotal movement of arms 25 and 26 about their spaced pivot axes in the direction of the arrows shown in this Figure. The pivot arms and the male die blocks connected thereto are thus moved into the phantom outline positions shown in FIG. 3 to effect spike straightening in a manner to be described more fully hereinafter.

Figure 7:
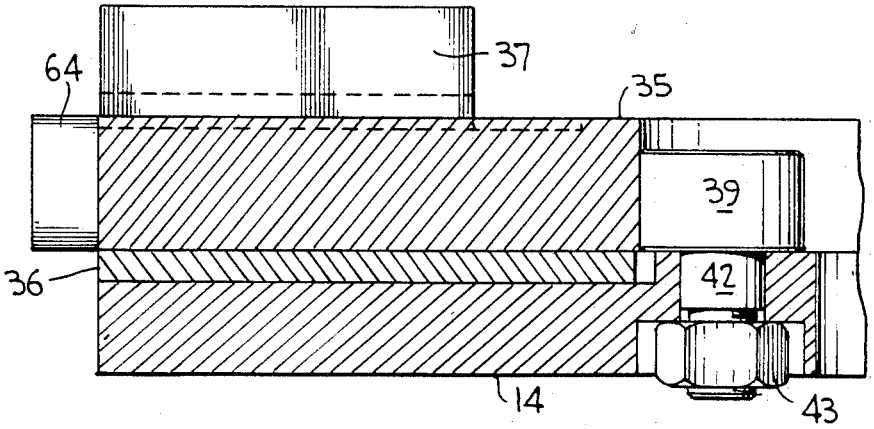
FIG. 7 is a sectional view taken substantially along the line 7—7 of FIG. 1.

An annular worktable 35 is supported on plate 14 via anti-friction bearings 36 (FIG. 7). A plurality of female die members 37 are fixedly mounted on the top surface of worktable 35 and are rotatable therewith about a central axis 38 of the table. For convenience, the female die members may be comprised of a pair of spaced die blocks as shown, or may be comprised of a single die block. In either case, the female die has a central longitudinally extending angular groove defined by a pair of angularly related support surfaces 40, 41 disposed at right angles. The female dies are arranged on table 35 so that the angular grooves thereof lie along radial lines extending from central axis 38 (FIG. 1). Circular bearings 39 engage an inner peripheral edge of table 35 for maintaining the concentricity of the table during its rotation, the bearings being mounted to the underlying support plate 14 via shafts 42 and nut fasteners 43 (FIG. 7). As seen in FIG. 1, fourteen equally sized female die members are equally spaced apart on the table with their inner edges in contacting engagement, although a larger or fewer number of female die members may be provided depending on size and need, without departing from the invention.

Returning to FIG. 3, it is to be pointed out that support surface 41 of the female die confronts and is opposed to an end 44 of male die block 29, and support surface 40 of the female die confronts and is opposed to an end 45 of male die block 31. And, outer sides 46 and 47 of the male die blocks are respectively spaced from pivot axes at pins 27 and 28, at equal distances, so as to move closely adjacent respective surfaces 40 and 41 of the female die into their phantom outline positions of FIG. 3 when clevis 19 is lowered during operation of the main hydraulic cylinder. And, portions of the die blocks at ends 44 and 45 thereof extending from their respective sides 46 and 47, define spike impact surfaces 48, 49 (FIG. 6) with the remaining portions of the make die block ends having spaced grooves 51 (FIGS. 5, 6) of equal width and parallel sides alternating between the male die blocks so that, when the male die blocks are lowered into their phantom positions of FIG. 3, portions of one of the blocks will be received within the grooves of the other to avoid interference between the male dies as impact surfaces 48 and 49 thereof press against a bent spike 52 lying along the angular groove of a female die disposed beneath the male dies.

Figure 5:
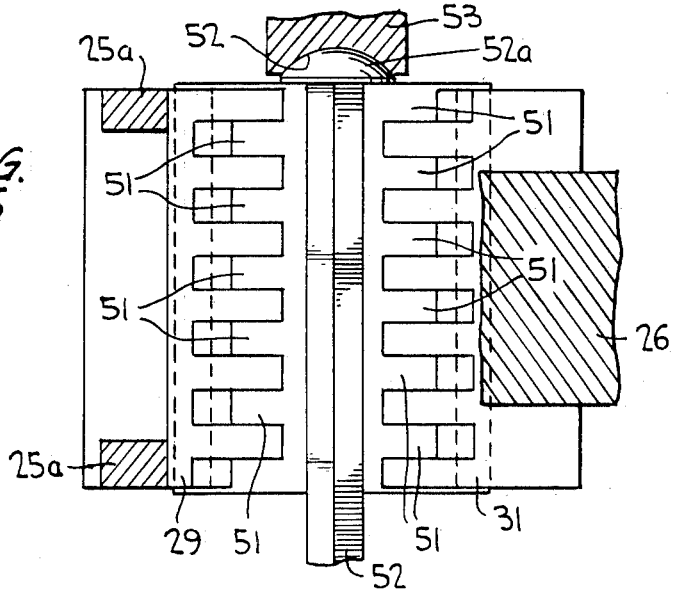
FIG. 5 is a view taken substantially along the line 5—5 of FIG. 3.
Figure 6:
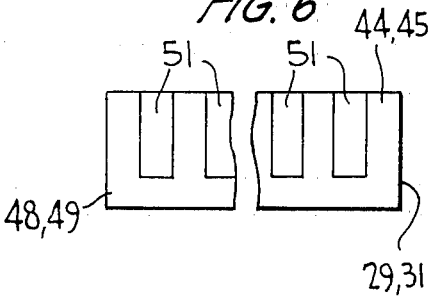
FIG. 6 is a typical end view of one of the male die blocks taken substantially along the line 6—6 of FIG. 3.

Oftentimes, the shafts of the rail spikes are not only bent but the heads are likewise distorted relative to the shafts. Thus, for the purpose of reforming the spike head, another hydraulically operated piston and cylinder unit 52 (FIG. 2) is mounted on the frame with its piston rod pivotally interconnected to a ram 53 disposed in alignment with the angular groove of the female die which lies beneath the male die block assembly. Pairs of spaced connecting links 54 extend between the ram and support plates 54 mounted on the frame to thereby guide the ram during its reciprocating movement. It can be seen that the ram has a concave end 56 for substantially matching the rounded head **52*a* of the rail spike (FIG. 5**).

The worktable for the female die members is incrementally rotated, in the direction of the arrow of FIG. 1, by the provision of a hydraulic cylinder 57 pivotally mounted at one end on an I-beam 13 of the frame, and pivotally mounted at its piston end to a pair of spaced flat bars 58 (FIG. 2). The bars are pivotally mounted at their inner end to another I-beam of the frame via a ring piece 59. A ratchet lever 61 is pivotally connected at one end to bars 58 via a bearing block 62, and has an undercut 63 at its free end for engagement with one of a plurality of pawls 64 which extend from the outer periphery of the table and are spaced equally at locations between outer edges of the female die members as shown in FIG. 1. A coil tension spring 65 extends between pins 66 and 67 respectively mounted on lever 61 and an upper bar 58 (FIG. 2).

A hydraulic table locking cylinder 68 is mounted on a plate 69 which is in turn adjacently mounted on a support plate 71 fixedly secured to a support beam 15 of the frame. A crossbar 72 on plate 69 extends between pairs of adjusting screws 73 mounted on beam 15, and pins 73 on plate 71 extend through elongated openings 74 in plate 69 for effecting an adjustment of plate 69 and hydraulic cylinder 68 mounted thereon in a direction along the elongated openings. A clevis 75 is fixed to plate 69 and receives a lock bar 76 pivotally mounted thereon. The lock bar has a cam lever 77 to which the piston and locking cylinder 68 is pivotally mounted. And, the lock bar has a cutout 78 adjacent to its free end shaped to match a typical pawl 64. Thus, upon retraction of the locking cylinder piston, the locking bar is moved outwardly into an unlocking position from that shown in FIG. 1.

A pneumatically operated ejection cylinder 79 is mounted on support plate 14 in alignment with the angular groove of one of the female die members spaced circumferentially from the female die member shown beneath the male die block assembly. The ejection cylinder has an impact plate 81 at the end of its piston disposed for contacting a straightened spike lying along the angular groove of the confronting female die member for ejecting same outwardly of the female die upon extension of the ejection piston.

MODE OF OPERATION

Used railway spikes which appear reusable, typically of a size $\frac{5}{8}''$ sq. and 6″ long, are visually inspected by the machine operator and are manually placed one-at-a-time on the female die members along the angular grooves thereof with head **52*a* of the spike lying outwardly of the female die. During a start-up operation, the pistons of each of the cylinders 17, 68, 57 and 79 are in a retracted position, and the piston of cylinder 52 is extended. Thus, the male die blocks are disposed in their solid outline positions of FIG. 3. The spike head ram 53 is retracted as shown in FIG. 1, lock bar 76 is out of engagement with a pawl 64, ratchet lever 61 is out of engagement with a pawl 64, and impack plate 81 of the ejection cylinder is retracted as shown in its position of FIG. 1. With the operator positioned at a loading station LS, for example, the rail spikes to be reformed are manually loaded one-at-a-time on to four female die members as rotatable support table 35 is rotated either manually or by a suitably provided motor means (not shown) until the first spike-loaded female die member is disposed at a straightening station SS with its angular groove in alignment with ram 53 and in a position relative to the male die blocks as shown in FIG. 3. The piston of locking cylinder 68 is then extended to cause lock bar 76 to engage a confronting pawl 64 for locking the table in this position. A number of pressure and limit switches are provided between the various moving parts of the present apparatus for controlling the synchronous movements thereof, although such switches are not illustrated in the drawings for the sake of clarity. Cylinder 17 is now actuated to effect movement of pivot arms 25, 26 and the male dies blocks 29, 31 mounted thereon, into the phantom outline positions thereof shown in FIG. 3. Surfaces 48, 49 of the male die blocks respectively impact against sides of the spike at a 90° angle such that the spike is simultaneously pressed against the confronting surfaces 40, 41 of the female die member. And, outer surface 46, 47 of the male die blocks are moved closely adjacent along respective surfaces 40, 41 when being moved into their phantom outline positions. The male die blocks are capable of avoiding interference with one another when impacting against the rail spikes by the provision of grooves 51 which alternate between the blocks so that portions of one of the blocks are received within the grooves of the other, as clearly shown in FIG. 3**.

The piston of cylinder 17 is then slightly retracted so as to relieve pressure on the spike somewhat, which is now been straightened, after which the piston of cylinder 52 is retracted for moving ram 53 in the direction of the arrow of FIG. 5, so as to impact against head 52*a* of the spike for reforming it relative to the shaft of the spike as the head is pressed against the outer side of the female die member. The piston of cylinder 52 is then extended, the piston of cylinder 17 is retracted, cylinder 68 is actuated for unlocking bar 76, and ratchet lever 61 is moved in the direction of its arrow of FIG. 1 as the piston of cylinder 57 is extended. It should be pointed out that the stroke of the cylinder 57 piston is such as to rotate the table by only a 1/14th turn such that the next adjacent female die member supporting a rail spike to be straightened is moved into straightening station SS. And, tension spring 65 acting between the ratchet bar and top bar 58, resiliently biases undercut 63 of the ratchet bar against the confronting pawl 64 as the bar is moved in the direction of its arrow.

After the table is rotated a 1/14th turn, ejection cylinder 79 is actuated for extending its piston so as to eject a straightened and reformed spike at ejection station ES as plate 81 on the piston slides along support surfaces 40, 41 of the female die member and pushes the straightened spike outwardly of the die. Of course, at the start of the straightening operation, straightened spikes will not be disposed in alignment with the ejection cylinder until the support table has been incrementally rotated, in the manner aforedescribed, through four 1/14th turns. Thereafter, at each incremental rotation of the support table, the operator manually loads an empty female die at loading station LS, and the aforedescribed sequence of operations proceeds for sequentially straightening the spikes as they are moved into straightening station SS. Thus, the table is locked in the position of FIG. 1 in readiness for actuation of cylinder 17 which effects downwardly pivoting movement of the pivot arms and the male die blocks connected thereto to effect spike straightening, after which the spike head is reformed upon actuation of its cylinder 52, the support table is unlocked as lock bar 76 is moved outwardly thereof, cylinder 57 is actuated for incrementally rotating the support table through a 1/14th turn, and ejection cylinder 79 is actuated for pushing a straightened rail spike out of the angular groove of a confronting female die member.

From the foregoing, it can be seen that a simple yet highly effective apparatus has been devised for straightening the shank of a rail spike by the provision of a male die assembly which avoids the need for guideways of any type and which assures the application of uniform and opposed pressures applied simultaneously against the rail spike to be straightened. And, the rail head may be reformed relative to the spike shank after which the rail spike is automatically ejected. The aforedescribed apparatus is likewise suitable for straightening elongated articles other than rail spikes, even those without heads. In such event, the operation of cylinder 52 may be disconnected, or simply be permitted to actuate but without effecting a head reforming operation.

Obviously, many other modifications and variations of the present invention are made possible in the light of the above teachings. It is therefore to be understood that within the scope of the appended claims the invention may be practiced otherwise than as specifically described.

What is claimed is:

1. An apparatus for straightening an elongated article, such as a rail spike, comprising a frame having a worktable, at least one stationary female die member mounted on said worktable and having a pair of angularly related surfaces for supporting an elongated article to be straightened, said surfaces defining an angular groove, first and second side facing support arms mounted on a portion of said frame at a spaced distance from one side of said worktable respectively for pivotal movement about first and second spaced axes, said female die member lying on said one side of said worktable, said groove opening outwardly of said side, first and second male die blocks respectively mounted on said first and second arms for movement therewith, one of said female die surfaces facing said first male die block, and the other of said female die surfaces facing said second male die block, and means connected to said support arms for simultaneously pivoting said arms about said axes to effect movement of said first and second male die blocks respectively toward and away from said one and said other female die surfaces and respectively along said other and said one female die surfaces whereby to impact against an unstraightened elongated article supported thereon for straightening same wherein only said first male die block, second male die block and angular groove cooperate with one another to straighten said article with only one angular groove in operative relationship with said first and second male die blocks during said article impacting, and said groove opening facing said simultaneous pivoting means.

2. The apparatus according to claim 1, wherein said pivoting means comprises a hydraulic unit pivotally linked to said support arms.

3. The apparatus according to claim 1, wherein said first and second blocks have outer sides respectively spaced from said first and second axes for respective movement closely adjacent along said other and said one female die surfaces.

4. The apparatus according to claim 3, wherein ends of said male die blocks confront said female die surfaces and include portions defining impact surfaces which extend to said outer sides of said blocks, the remainder of said ends having spaced grooves of equal width and parallel sides alternating between said blocks so that, upon the movement of said blocks, portions of one of said blocks will be received within the grooves of the other.

5. The apparatus according to claim 1, further comprising pressurized article reforming means mounted on said frame for applying pressure against one end of said female die member in a direction along said angular groove thereof, whereby the head of a headed elongated article when supported on said surfaces of said female die member can be reformed relative to the shank thereof by pressing the head against said one end of said female die member.

6. The apparatus according to claim 5, wherein said pressurized article reforming means comprises a movable ram having a concave recess at the terminal end thereof.

7. The apparatus according to claim 1, further comprising means on said frame for ejecting the straightened article from said female die member, said ejecting means lying outwardly of one end of one of said female die members along said angular groove thereof.

8. The apparatus according to claim 7, further comprising means on said frame spaced from said straightening station for ejecting the straightened article from said female die member, said ejecting means lying outwardly of an end of one of said female die members along said angular groove thereof.

9. An apparatus for straightening an elongated article, such as a rail spike, comprising a frame, a worktable mounted on said frame for rotation about a central axis, a plurality of female die members mounted on said worktable and having pairs of angularly related surfaces for supporting elongated articles to be straightened, said pairs of surfaces defining angular grooves extending radially of said central axis, first and second side facing support arms mounted on said frame respectively for pivotal movement about first and second spaced axes, first and second male die blocks respectively mounted on said first and second arms for movement therewith, one of said female die surfaces facing said first male die block, and the other of said female die surfaces facing said second male die block, means for intermittently rotating said worktable about said central axis for sequentially disposing each said female die member into an article straightening station wherein said groove thereof lies parallel to said first and second spaced axes, means on said frame for intermittently locking said worktable for retaining each said female member at said station, and means connected to said support arms for simultaneously pivoting said arms about said spaced axes to effect movement of said first and second male die blocks respectively toward and away from said one and said other female die surfaces and respectively along said other and said one female die surfaces whereby to impact against an unstraightened elongated article supported thereon for straightening same at said station.

10. The apparatus according to claim 9, further comprising pressurized article reforming means mounted at said station on said frame for applying pressure against one end of said female die member, in a direction along said angular groove thereof, whereby the head of a headed elongated article when supported on said surfaces of said female die member can be reformed relative to the shank thereof by pressing the head against said one end of said female die member.

* * * * *